US011970259B2

(12) United States Patent
Bangslund et al.

(10) Patent No.: US 11,970,259 B2
(45) Date of Patent: Apr. 30, 2024

(54) SHAFT LINKAGE FOR LINKING AND DRIVING AT LEAST TWO DRIVETRAINS OF A VESSEL

(71) Applicant: Svitzer A/S, Copenhagen (DK)

(72) Inventors: Thomas Bangslund, Copenhagen (DK); Esben Grundtvig, Copenhagen (DK)

(73) Assignee: Svitzer A/S, Copenhagen K (DK)

( * ) Notice: Subject to any disclaimer, the term of this patent is extended or adjusted under 35 U.S.C. 154(b) by 82 days.

(21) Appl. No.: 17/403,635

(22) Filed: Aug. 16, 2021

(65) Prior Publication Data

US 2021/0371076 A1 Dec. 2, 2021

Related U.S. Application Data

(63) Continuation of application No. PCT/EP2020/056377, filed on Mar. 10, 2020.

(30) Foreign Application Priority Data

Mar. 11, 2019 (DK) ..... 201900302

(51) Int. Cl.
*B63H 23/18* (2006.01)
*B63H 5/08* (2006.01)
(Continued)

(52) U.S. Cl.
CPC ..... *B63H 23/12* (2013.01); *B63H 5/08* (2013.01); *B63H 23/18* (2013.01); *B63H 23/30* (2013.01);
(Continued)

(58) Field of Classification Search
CPC ..... B63H 23/30; B63H 23/10; B63H 23/12; B63H 23/14; B63H 23/16; B63H 23/18;
(Continued)

(56) References Cited

U.S. PATENT DOCUMENTS 3,707,939 A * 1/1973 Berg ..... B63H 5/125 440/58
4,188,837 A * 2/1980 Bendall ..... B63H 23/18 74/665 M
(Continued)

FOREIGN PATENT DOCUMENTS

CN 2474708 Y 1/2002
DE 8615676 U1 8/1990
(Continued)

OTHER PUBLICATIONS

International Search Report and Written Opinion dated Jul. 10, 2020 for PCT Application No. PCT/EP2020/056377.
(Continued)

*Primary Examiner* — Andrew Polay
(74) *Attorney, Agent, or Firm* — EIP US LLP

(57) ABSTRACT

A linking drive system comprises a first drive shaft of the first drivetrain connected between a first prime mover and a first propulsor. The linking drive system comprises a second drive shaft of the second drivetrain connected between a second prime mover and a second propulsor. The linking drive system further comprises a linking drive clutch, which comprises at least a first clutch part and a second clutch part. The first clutch part and the second clutch part are engageable with each other and can transmit rotation therebetween. At least one flexible drive link is coupled between the linking drive clutch and the first and/or second drive shafts. Rotation from one of the first and second drive shafts is transferred to the other of the first and second drive shafts when the linking drive clutch is engaged thereby linking the first and second drivetrains.

16 Claims, 10 Drawing Sheets

(51) Int. Cl.

| | |
|---|---|
| ***B63H 23/12*** | (2006.01) |
| ***B63H 23/30*** | (2006.01) |
| *B63H 23/02* | (2006.01) |
| *B63H 23/06* | (2006.01) |

(52) U.S. Cl.
CPC ..... *B63H 2023/0216* (2013.01); *B63H 2023/062* (2013.01)

(58) Field of Classification Search
CPC .... B63H 2023/0208; B63H 2023/0216; B63H 2023/0225; B63H 2023/0233; B63H 2023/0241; B63H 2023/025; B63H 2003/088
See application file for complete search history.

(56) References Cited

U.S. PATENT DOCUMENTS

| | | | | |
|---|---|---|---|---|
| 4,311,472 | A | 1/1982 | Hiersig et al. | |
| 4,344,760 | A | 8/1982 | Kulikowski | |
| 4,563,940 | A * | 1/1986 | Wuhrer | B63H 3/08 416/49 |
| 5,178,566 | A * | 1/1993 | Stojkov | B63H 20/32 474/140 |
| 5,954,552 | A * | 9/1999 | Lauterbach | F16D 27/112 440/38 |
| 7,244,154 | B1 * | 7/2007 | Connell | B63H 23/30 440/86 |
| 9,321,516 | B1 | 4/2016 | Lafreniere et al. | |
| 2005/0106958 | A1 | 5/2005 | Ohtsuki | |
| 2009/0215338 | A1 * | 8/2009 | Suzuki | B63H 21/213 440/86 |
| 2014/0364265 | A1 | 12/2014 | Bentgen et al. | |
| 2021/0214063 | A1 * | 7/2021 | Scholz | B63H 23/18 |

FOREIGN PATENT DOCUMENTS

| | | | |
|---|---|---|---|
| DE | 29712368 | U1 | 10/1997 |
| EP | 0246631 | A1 | 11/1987 |
| GB | 265627 | A | 5/1927 |
| GB | 479058 | A | 1/1938 |
| GB | 684498 | A | 12/1952 |
| GB | 1269043 | A | 3/1972 |
| JP | H08150999 | A | 6/1996 |
| RU | 2008145530 | A | 5/2010 |
| RU | 2499726 | C2 | 11/2013 |
| WO | 2010141873 | A2 | 12/2010 |

OTHER PUBLICATIONS

Danish Office Action dated Sep. 10, 2019 for Denmark Application No. PA201900302.

* cited by examiner

SHAFT LINKAGE FOR LINKING AND DRIVING AT LEAST TWO DRIVETRAINS OF A VESSEL

CROSS-REFERENCE TO RELATED APPLICATIONS

This application is a continuation of International Application No. PCT/EP2020/056377, filed Mar. 10, 2020 which claims priority to Denmark Application No. PA201900302, filed Mar. 11, 2019, under 35 U.S.C. § 119(a). Each of the above-referenced patent applications is incorporated by reference in its entirety.

BACKGROUND

The present invention relates to a drive system for linking and driving at least two drivetrain systems. More specifically to a flexible linkage drive system for linking and driving at least two drivetrain systems of a vessel.

Vessels such as tugboats have engines that typically produce 500 to 3,500 kW (~680 to 3,400 hp).

Tugboats can have different types of propulsors for their method of propulsion. Some tugboats have two propulsors such as azimuthing thrusters to provide thrust. If an engine failure occurs, then the inoperative azimuthing thruster can produce a big drag load. If this happens close to shore when heading back to a harbor, the problem could be minor. However, if the tugboat or vessel is in operation or far away from shore, any failure of the engine could become a serious problem.

Tugboats can be massively over engineered to provide very high peak loads. In most operations, for example during free sailing, maximum peak load is not required by the engine. It may be desirable to have a system that minimizes running hours on the engines as well as increasing the load on the engine in operation and therefore only running low load when sailing between two locations.

Furthermore, in some circumstances it may be advantageous to have a system that can flexibility in the operation of the tugboat engines.

Examples of the present invention aim to address and overcome fully or at least partly the aforementioned problems.

SUMMARY

The present invention provides a linking drive system for coupling together a first drivetrain and a second drivetrain of a vessel comprising: a first drive shaft of the first drivetrain connected between a first prime mover and a first propulsor; a second drive shaft of the second drivetrain connected between a second prime mover and a second propulsor; a linking drive clutch, the linking drive clutch comprising at least a first clutch part and a second clutch part which are engageable with each other and can transmit rotation therebetween; at least one flexible drive link coupled between the linking drive clutch and the first and/or second drive shafts; wherein rotation from one of the first and second drive shafts is transferred to the other of the first and second drive shafts when the linking drive clutch is engaged thereby linking the first and second drivetrains.

In an example, the at least one flexible drive link may comprise: at least a first flexible drive link, the first drive link being coupled between the first drive shaft and the first clutch part of the linking drive clutch; and at least a second flexible drive link coupled between the second drive shaft and the second clutch part of the linking drive clutch.

In an example, the linking drive system may comprise a chain drive or a belt drive.

In an example, the at least first and second flexible drive links may be coupled to the first and second drive shafts on a prime mover side of a main drive clutch.

In an example, the at least first and second flexible drive links may be coupled to the first and second drive shafts on a propeller side of a main drive clutch.

In an example, the at least first and second flexible drive links may be coupled to the first and second drive shafts on a linking drive clutch side of a hydraulic pump of the propulsor such that the hydraulic pump can operate a slew of the propulsor when the linking drive clutch is engaged.

In an example, the linking drive system may comprise a linking drive clutch controller configured to control the engagement of the first clutch part and the second clutch part.

In an example, the linking drive system may comprise a sensor for detecting a rotation of at least one of the first and second drive shafts, the first and second flexible drive links or the first clutch part and the second clutch part.

In an example, the linking drive clutch controller may be configured to activate the engagement of the first clutch part and the second clutch part when there is no relative rotation, or below a pre-defined threshold rotation.

In an example, the linking drive clutch may be an electromagnetic clutch.

In an example, the linking drive system may be a chain drive system and the chain drive system comprises at least a first sprocket and a second sprocket, wherein the first sprocket is coupled to the first drive shaft and the second sprocket is coupled to the second drive shaft, and the at least first and the at least second flexible drive links are chains.

In an example, the chains may be each enclosed in a chain box.

In an example, the chain box may comprise a reservoir or a spraying device for lubricating the chains.

In an example, the linking drive system may comprise at least one diverter sprocket, the diverter sprocket is arranged such that the direction of at least a portion of the chain is diverted In another aspect of the invention there is provided a vessel comprising a drive system according the previous aspect.

In an example, the vessel according may be a tugboat.

In another aspect of the invention there is provided a linking drive kit mountable on a vessel drive system for coupling together a first drivetrain and a second drivetrain of a vessel comprising: a linking drive clutch, the linking drive clutch comprises at least a first clutch part and a second clutch part which are engageable with each other and can transmit rotation therebetween; at least a first chain, the first chain is coupled between a first drive shaft of the first drivetrain and the first clutch part of the linking drive clutch, the first drive shaft being connected between a first prime mover and the first propulsor; and at least a second chain coupled between a second drive shaft of the second drivetrain and the second clutch part of the linking drive clutch, the second drive shaft being connected between a second prime mover and the second propulsor; wherein the rotation from one of the first and second drive shafts can be transferred to the other of the first and second drive shafts when the linking drive clutch is engaged, linking the first and second drivetrains.

The invention will now be described, by way of example only, with reference to the accompanying drawings, in which:

DETAILED DESCRIPTION

The invention will, for simplicity, be explained throughout the application in relation to a vessel, namely at tugboat. However, in other examples, the vessel can be any other types of vessel that have at least two prime movers and each prime mover having at least one propulsor associated therewith. For example, the vessel can be a platform supply vessel, an anchor handler, a ferry, a barge, a container ship, a tanker, a fishing boat, a cruise ship, a yacht or any other type of vessel. Hereinafter, the term "tugboat" will be used, but the tugboat can be any type of vessel.

Figure 1:
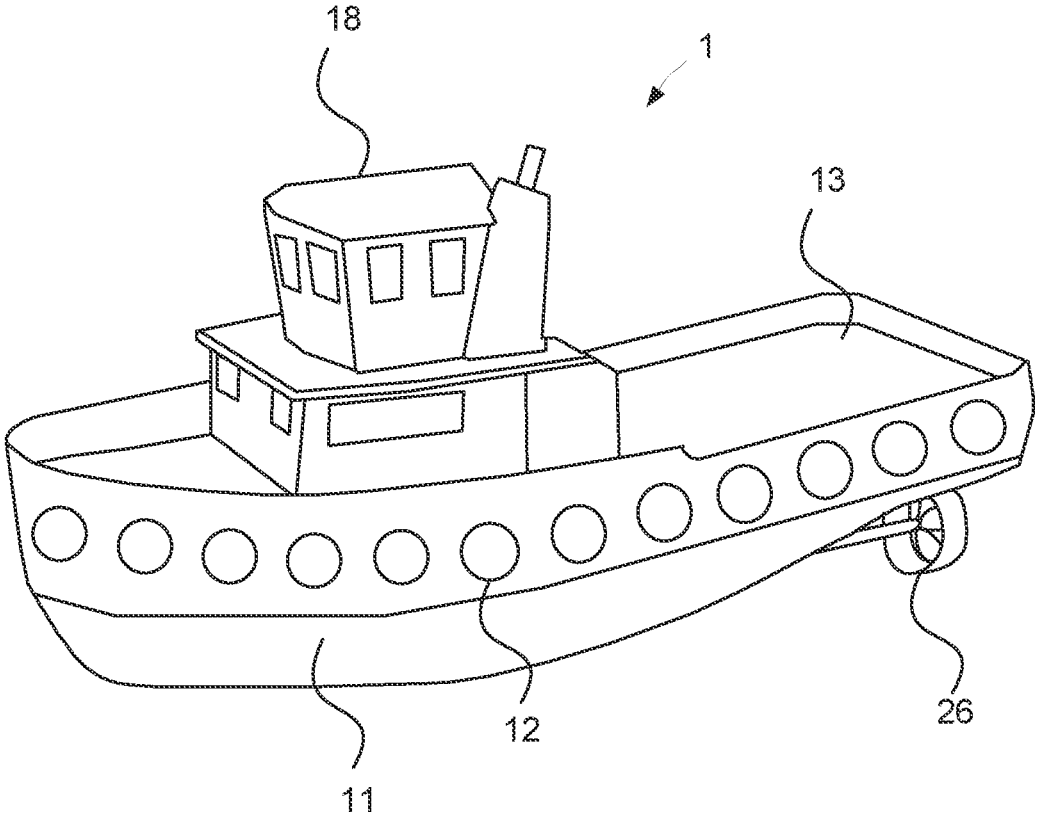
FIG. 1 shows a perspective view of an example of a vessel such as a tugboat having propulsors.

FIG. 1 shows a perspective view of an example of a vessel such as a tugboat 1 having propulsors 26, 36. The tugboat 1 is for assisting a marine vessel, such as a container ship, to maneuver. Operation of the tugboat 1 for maneuvering a container ship is known and will not be discussed in further detail.

The tugboat 1 includes a hull 11 and fenders 12. In other examples of the tugboat 1, the fender 12 could be omitted. The tugboat 1 also has a deck 13 and a wheelhouse 18 mounted on the deck 13 and/or the hull 11.

The tugboat 1 comprises a plurality of propulsors 26, 36 for providing propulsion to the tugboat 1. FIG. 1 shows a single propulsor 26, but further propulsors may be provided. In some examples, the propulsor 26 is an azimuth thruster 26. In some examples, the tugboat 1 normally has two propulsors 26, 36. In some examples, the plurality of propulsors 26, 36 are azimuthing thrusters which can rotate about a vertical axis to direct thrust in a plurality of directions. Some azimuthing thrusters are azimuthing podded drives which are also known as "azipods". Hereinafter, azimuthing podded drives will be referred to as azimuth thrusters. The second propulsor 36 (not shown in FIG. 1 but shown in FIG. 2B) is located adjacent and parallel to the first propulsor 26.

In an example, the at least one propulsor 26, 36 is one or more of: a propeller, a thruster, a rudder propeller, an electric rudder propeller, a fixed pitch propeller, a variable pitch propeller, an azimuthing thruster, a water jet propulsor, or an azimuthing podded drives thruster. In another example, the at least one propulsor 26, 36 are bow thrusters. Yet another example, the at least one propulsor 26, 36 are stern thrusters. In an example, at least one propulsor 26, 36 are azimuthing podded drives. In some examples, the at least one propulsor 26, 36 are propellers. In an example, the at least one propeller 26, 36 is a fixed or variable pitch propeller. In an example, at least one propulsor 26, 36 is a plurality of propulsors comprising a combination of two or more of: a propeller, a thruster a rudder propeller, an electric rudder propeller, a fixed pitch propeller, a variable pitch propeller, an azimuthing thruster, a water jet propulsor, or an azimuthing podded drives. In yet other examples, the at least one propulsor 26, 36 can be any means suitable for providing propulsion to the tugboat 1.

Figure 2A:
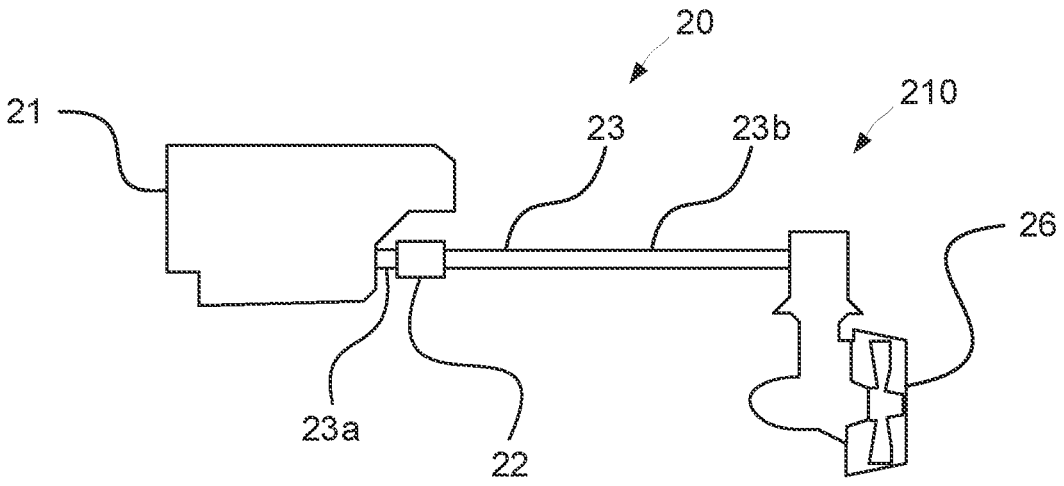
FIGS. 2A and 2B show a schematic side view of propulsion systems for a vessel comprising two propulsors.

An example of a configuration of a first propulsion drivetrain system 20 for the first propulsor 26 is illustrated in FIG. 2A. FIG. 2A illustrates a schematic side view of the first propulsion drivetrain system 20 for a vessel comprising two propulsors, 26, 36.

FIG. 2A discloses the first propulsion drivetrain system 20 comprising the first propulsor 26 and a first prime mover 21. The first propulsor 26 is coupled to and driven by a first prime mover 21. In some examples, the first prime mover 21 can be a diesel engine, electrical motor, or a diesel-electric hybrid system. The diesel engine can be a 4-stroke diesel engine or a 2-stroke diesel engine. In other examples, the first prime mover 21 is an internal combustion engine that can burn any type of fossil fuel. In some examples, the first prime mover 21 can be any suitable means for powering the first propulsor 26.

The first propulsor 26 and the first prime mover 21 are coupled together by a first drivetrain 210. The first drivetrain 210 comprises a first drive shaft 23 having a first and second part 23*a*, 23*b* connected to the first prime mover 21. In some examples, the first drivetrain 210 comprises one or more gearboxes and clutches for transmitting drive from the first prime mover 21 to the first propulsor 26. In some examples, the first drivetrain 210 comprises a first main drive clutch 22. The first main drive clutch 22 is configured for selectively engaging the first prime mover 21 to the first propulsor 26.

The first part 23*a* of the first drive shaft 23 is connected between the first prime mover 21 and a first main drive clutch 22. The second part 23*b* of the first drive shaft 23 is connected between the first main drive clutch 22 and the first propulsor 26.

Figure 2B:
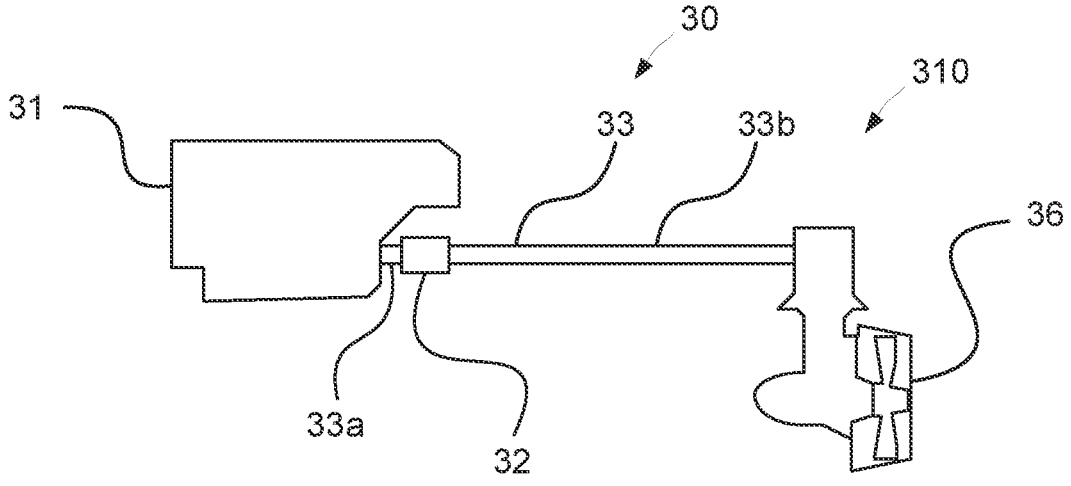

The second propulsor 36 will have a similar propulsion drivetrain system 30 to the first propulsion drivetrain system 20. The second propulsion drivetrain system 30 will now be described with reference to FIG. 2B. FIG. 2B illustrates a schematic side view of the second propulsion drivetrain system 30 for a vessel comprising two propulsors, 26, 36.

FIG. 2B discloses second propulsion drivetrain system 30 comprising the second propulsor 36 and a second prime mover 31. The second propulsor 36 is coupled to and driven by a second prime mover 31. Similar to the first propulsion drivetrain system 20, in some examples, the second prime mover 31 can be a diesel engine, electrical motor, or a diesel-electric hybrid system. The diesel engine can be a 4-stroke diesel engine or a 2-stroke diesel engine. In other examples, the second prime mover 31 is an internal combustion engine that can burn any type of fossil fuel. In some examples, the second prime mover 31 can be any suitable means for powering the second propulsor 36.

The second propulsor 36 is coupled together by a second drivetrain 310. The second drivetrain 310 comprises a second drive shaft 33 having a first and second part 33*a*, 33*b* connected to the first prime mover 21. In some examples, the second drivetrain 310 comprises one or more gearboxes and clutches for transmitting drive from the second prime mover 31 to the second propulsor 36. In some examples, the second drivetrain 310 comprises a second main drive clutch 32. The second main drive clutch 32 is configured for selectively engaging the second prime mover 31 to the second propulsor 36.

The first part 33*a* of the second drive shaft 33 is connected between the second prime mover 31 and a second main drive clutch 32. The second part 33*b* of the second drive shaft 33 is connected between the second main drive clutch 32 and the second propulsor 36. In other examples of the first and second drivetrain systems 20, 30, the first and second main drive clutches 22, 32 could be omitted and the first and second propulsors 26, 36 are respectively directly connected to the first and second prime mover 21, 31.

Figure 3:
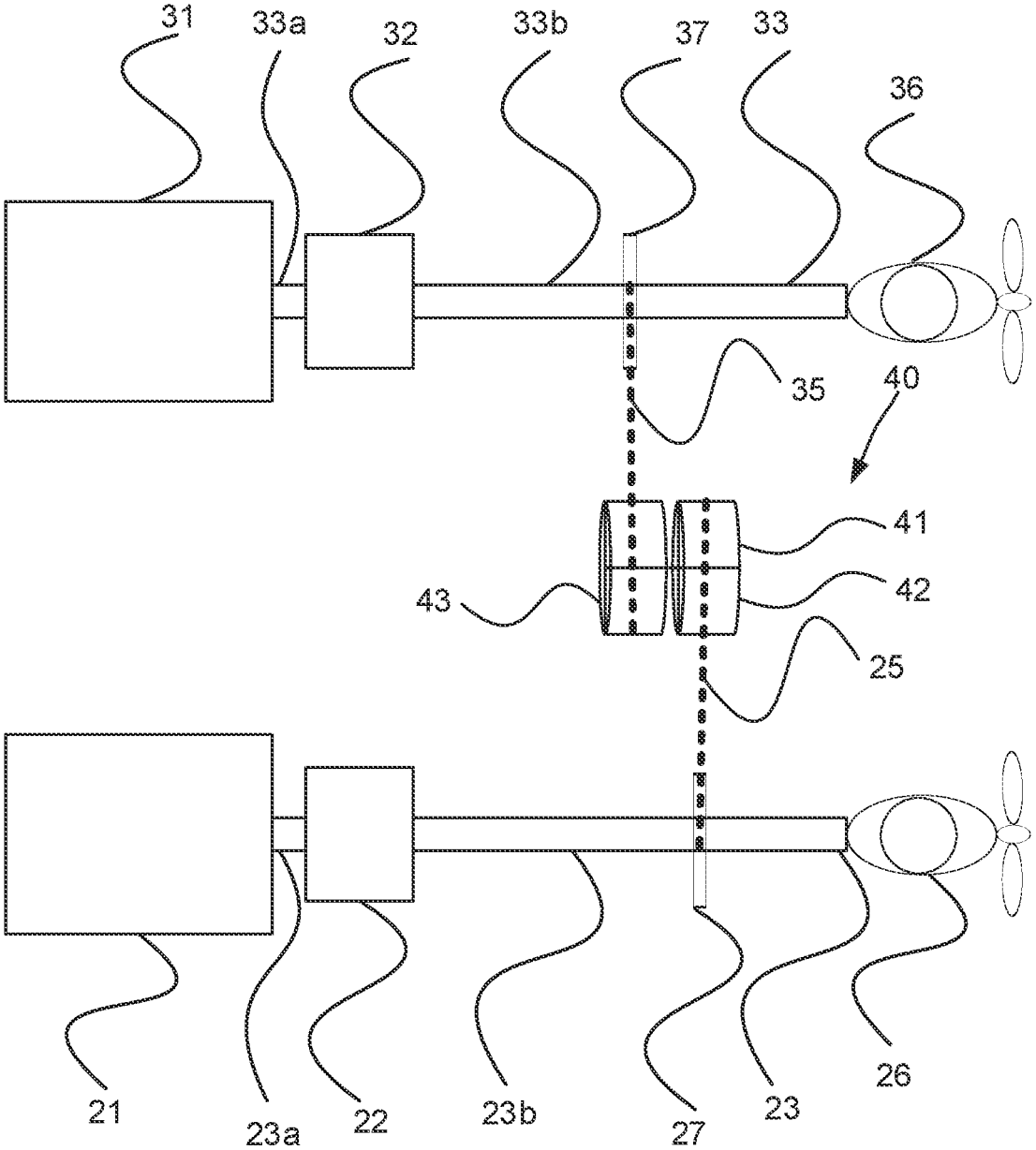
FIG. 3 shows a schematic cross-sectional top view of a tugboat having two propulsors and a linking drive system.

Now turning to FIG. 3, the tugboat 1 will be discussed in further detail. FIG. 3 discloses a schematic cross-sectional top view of a tugboat 1 having two propulsors 26, 36 and a linking drive system 40. The linking drive system 40 is selectively engageable for transmitting drive between the first and second drivetrain systems 20, 30 of the tugboat 1. In this way, drive can be transmitted from the first prime mover 21 to the second propulsor 36. Alternatively, drive can be transmitted from the second prime mover 31 to the first propulsor 26. In some examples, the linking drive system 40 can comprise at least one chain drive, or a belt drive. In other examples, the linking drive system 40 can be any suitable drive means for providing drive between the first and second drive shafts 23, 33.

The linking drive system 40 further comprises a linking drive clutch 41 for selectively coupling the drive between the first and second drive shafts 23, 33. The linking drive clutch 41 comprises at least a first clutch part 42 and second clutch part 43 which are engageable with each other and can transmit rotation therebetween. Either the first or second prime mover 21, 31 can provide drive to both the first and second propulsors 26, 36 via the linking drive system 40. Accordingly, the first clutch part 42 can drive the second clutch part 43. Alternatively, the second clutch part 43 can drive the first clutch part 42. As shown in FIG. 3, the linking drive clutch 41 is mounted between the first and second drive shafts 23, 33. In other examples, the linking drive clutch 41 can be mounted on either the first or second drive shaft 23, 33. In this example both of the first clutch part 42 and second clutch part 43 are mounted on e.g. the first drive shaft 23. In this way, a single flexible drive link 25 is used to couple the drive between the first and second drive shafts 23, 33.

The first clutch part 42 and second clutch part 43 are selectably moveable between a first position in which the first clutch part 42 and second clutch part 43 are not in physical engagement and no rotation is transmitted and a second position in which the first clutch part 42 and second clutch part 43 are in physical engagement and rotation is transmitted therebetween. The linking drive clutch 41 can be any type of clutch such as a slip clutch, a non-slip clutch, a mechanical or an electromagnetic clutch. The linking drive clutch 41 can also be operable remotely, e.g. from the wheelhouse 18 of the tugboat 1.

The linking drive system 40 further comprises at least a first flexible drive link 25. The first flexible drive link 25 is coupled between the first drive shaft 23 and the first clutch part 42 of the linking drive clutch 41. The linking drive system 40 also comprises at least a second flexible drive link 35. The second flexible drive link 35 is coupled between the second drive shaft 33 and the second clutch part 43 of the clutch 41. By using the linking drive system 40 and having the above configuration, the rotation from one of the first and second drive shafts 23, 33 can be transferred to the other of the first and second drive shafts 23, 33 when the linking drive clutch 41 is engaged. In this way, when the linking drive clutch 41 is engaged, the first and second drivetrains 210, 310 are linked. This means that a single prime mover 21, 31 (e.g. the first or the second prime mover 21, 31) can drive both the first and second propulsors 26, 36. Advantageously if one of the prime movers 21, 31 is inoperable, the other prime mover 21, 31 can power the first and second propulsors 26, 36.

Figure 7A:
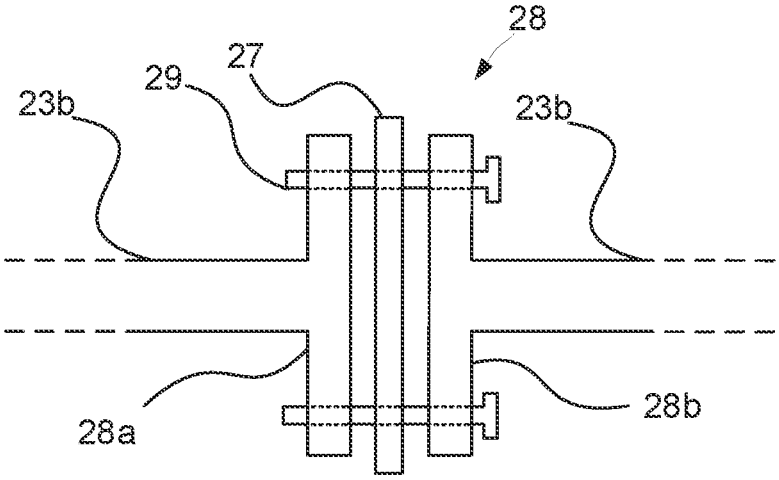
FIGS. 7A. 7B and 7C show schematic cross-sectional side views of sprockets connected to a flange of a main drive clutch.
Figure 7B:
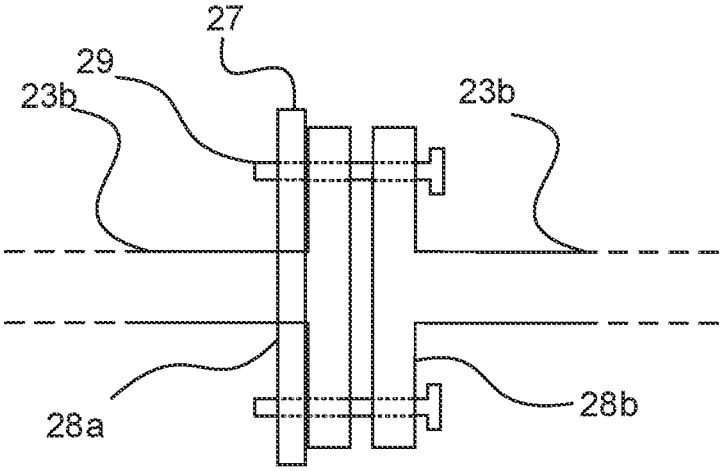
Figure 7C:
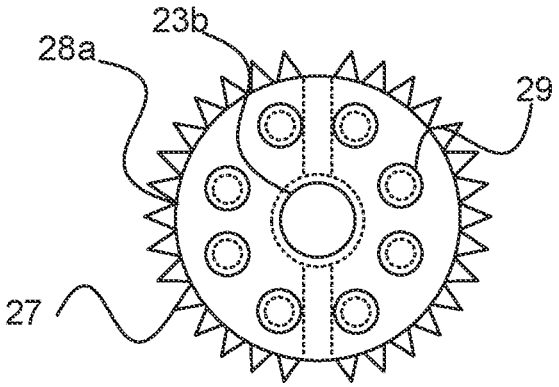
Figure 8:
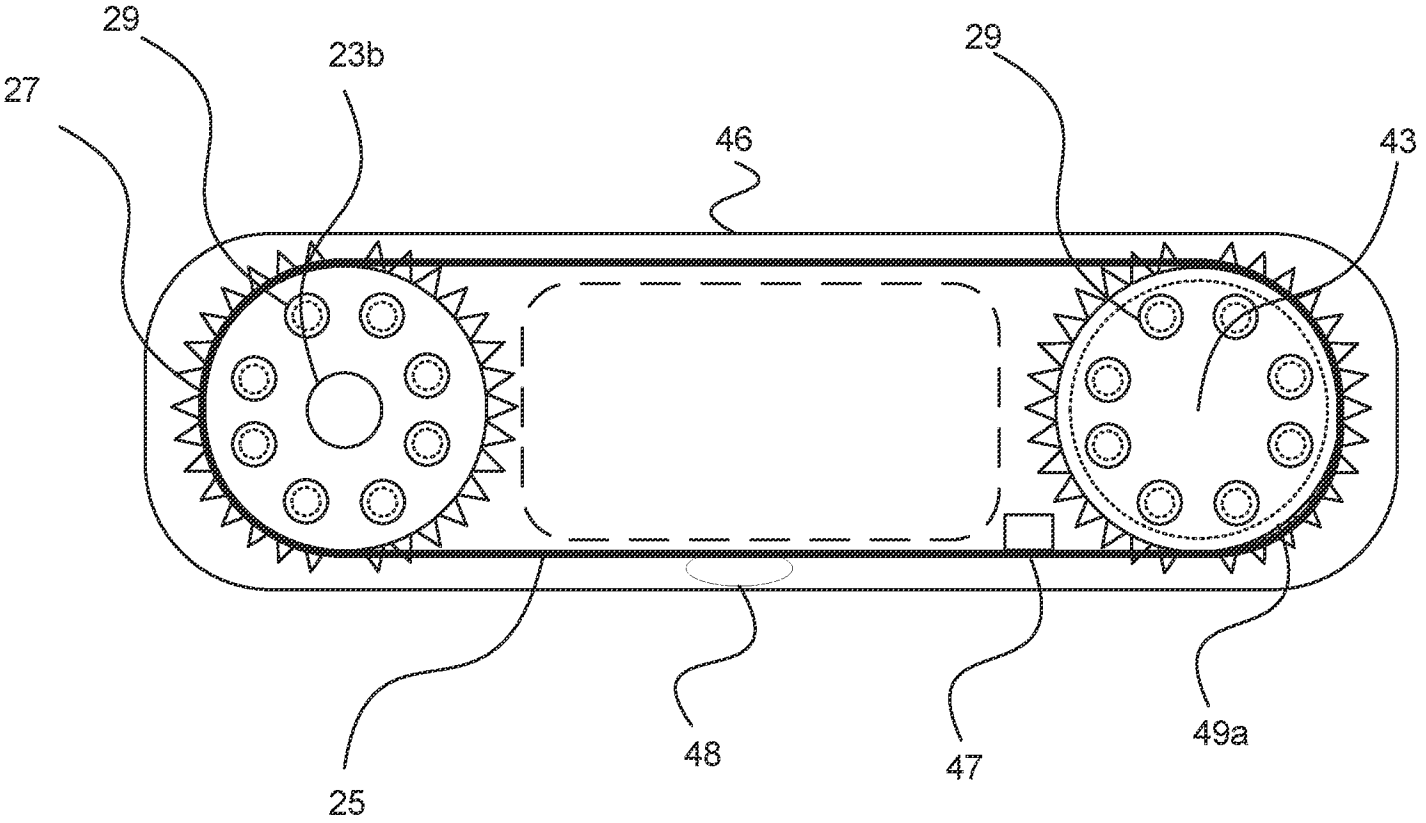
FIG. 8 shows a schematic cross-sectional side view of a chain box comprising a chain and an oiling mechanism.

In an example, the linking drive system 40 is a chain drive system 40 in which the first flexible drive link 25 and the second flexible drive link 35 are a first and a second drive chain 25, 35. The chain drive system 40 will be described briefly turning to FIG. 7A and FIG. 3. FIG. 7A shows a schematic cross-sectional side views of a first sprocket 27 connected to at least one flange 28 e.g. first and second flanges 28*a*, 28*b* of the first drive shaft 23. In an example, the linking drive system 40 comprises a first and second sprockets 27, 37 respectively mounted on the first and second drive shafts 23, 33. FIG. 7A only shows the first drive shaft 23, but the second sprocket 37 is mounted to the second drive shaft 33 in the same way as shown in FIG. 3. The first and second sprockets 27, 37 mesh with the first and second drive chains 25, 35. The first and second sprockets 27, 37 can be attached to the first and second drive shafts 23, 33 in different ways which will be discussed in further detail below with respect to FIGS. 7A to 7C. Similarly, the first clutch part 42 and second clutch part 43 respectively comprise first and second clutch sprockets 49*a*, 49*b* (as best shown in FIG. 8) for meshing with the first and second drive chains 25, 35.

As mentioned above, the second part 23*b* of the first drive shaft 23 connects between the first main drive clutch 22 and the first propulsor 26. In an example, the first sprocket 27 is mounted on the second part 23*b* of the first drive shaft 23 outputted from the first main drive clutch 22. In other examples, the first sprocket 27 and the second sprocket 37 can be mounted at any position on the first and second drive shafts 23, 33.

The first and second flexible drive links 25, 35 can easily be directed around any existing parts of the tugboat 1 which allows for easier installation of the linking drive system 40. Existing parts could be pipes for water, hydraulics, fuel, or sensors or any other already existing installation in the tugboat 1. Advantageously, this means that retrofit of the linking drive system 40 can mounted on existing drivetrain systems of a tugboat 1.

Furthermore, the linking drive system 40 being a chain drive or a belt drive will advantageously mean that the first and second drive shafts 23, 33 will rotate in the same direction. This means that the linking drive system 40 can be simple and does not require additional gearboxes for reversing the rotation of e.g. linking transmission drive shafts between the first and second drive shafts 23, 33.

Figure 4A:
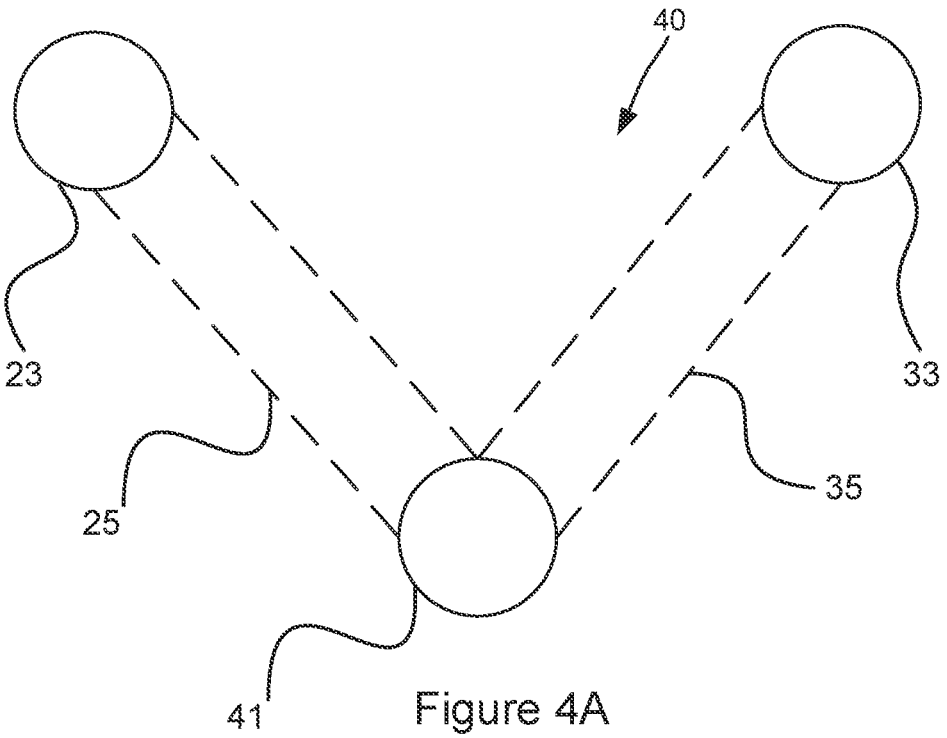
FIGS. 4A and 4B show a schematic view of different layouts of flexible driving links of a linking drive system.
Figure 4B:
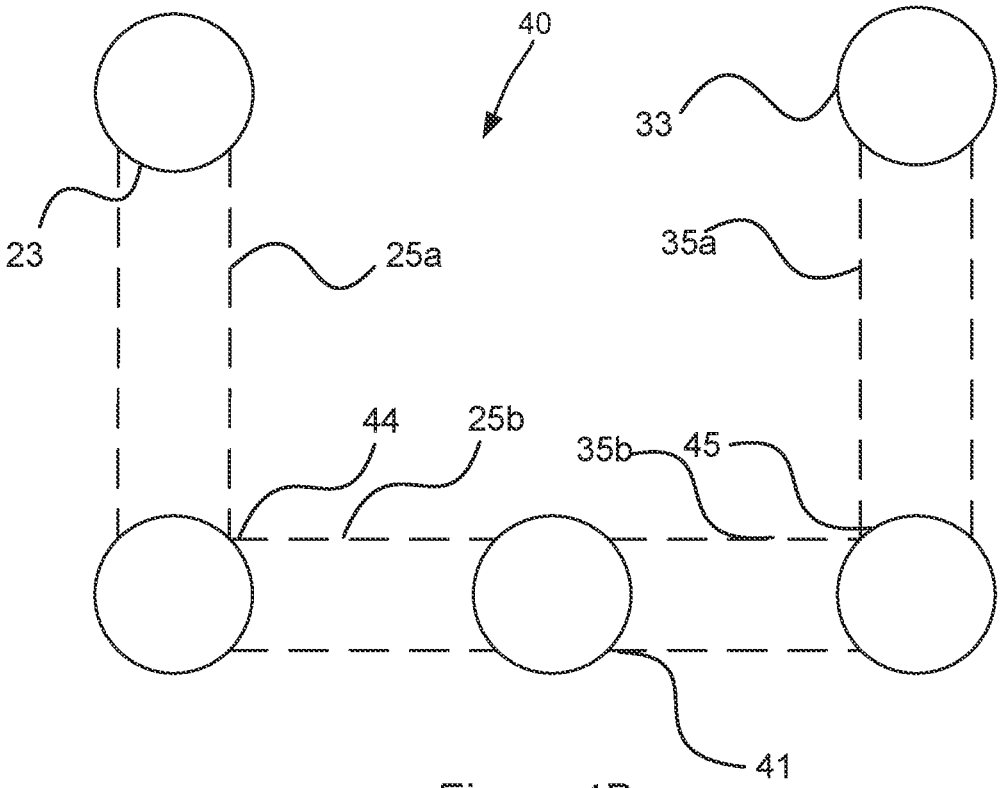

Some examples of different configurations for the first and second flexible drive links 25, 35 will be further discussed in relation to FIGS. 4A and 4 B. FIGS. 4A and 4B show a schematic view of different layouts of the first and second flexible drive links 25, 35 of the linking drive system 40.

For example, the linking drive system 40 is mounted in the tugboat 1 such that first and second flexible drive links 25, 35 take a path which is a "V shape". The linking drive clutch 41 is mounted in the centre of the V shape, illustrated in FIG. 4A.

In some alternative examples, the linking drive system 40 is mounted in the tugboat 1 such that the first and second flexible drive links 25, 35 take a path which is a "U shape". The linking drive clutch 41 is mounted with the linking drive clutch 41 in the centre of the U shape, illustrated in FIG. 4B.

Also illustrated in FIG. 4B are additional linking diverter sprockets 44, 45 for forming the U shape. The shape or path of the first and second flexible drive links 25, 35 can be customized in any way with first and second linking diverter sprockets 44, 45. In some examples, there can be any number of linking diverter sprockets 44, 45. FIGS. 4A and 4B show two exemplary paths for the linking drive system 40, but in other examples there can be any number of flexible drive links 25, 35 and linking diverter sprockets 44, 45 to guide the linking drive system 40 along any shaped path. In some examples, the number of linking diverter sprockets 44, 45 are selected depending on how many turns around existing components in the tugboat 1 is needed.

In some examples, the first and second flexible drive links 25, 35 are both single chain loops. However, in other examples, the first and/or the second flexible drive links 25, 35 comprise a plurality of chain loops. For example, the first and second flexible drive links 25, 35 are separated in to many smaller flexible drive links along a desired path.

Turning to FIG. 4B, this will be discussed in further detail. For example, the U shape illustrated in FIG. 4B could comprise four flexible drive links 25*a*, 25*b*, 35*a*, 35*b*. A first flexible drive link 25*a* is connected between the first drive shaft 23 and the first linking diverter sprocket 44. A second flexible drive link 25*b* is connected between the second linking diverter sprocket 44 and the linking drive clutch 41. A third flexible drive link 35*b* is connected between the linking drive clutch 41 and the second linking diverter sprocket 45. A fourth flexible drive link 35*b* is connected between the second linking diverter sprocket 45 and the second drive shaft 33. The flexible drive links 25, 35 are designed to be of a size and material that can withstand any effect on the first and second drive shafts 23, 33 produced by the prime movers 21, 31 and that is to be transferred to the other drive shaft 23, 33.

In some examples as mentioned above, the flexible drive links 25, 35 are a chain. The chain comprises a plurality of chain link pieces (not shown for the purposes of clarity). At least one of the chain link pieces is a removeable chain link piece. The removeable chain link piece can be disassembled and permits the flexible drive links 25, 35 to be removed from the linking drive system 40. This permits replacement or maintenance of the chain. In some examples, each chain link piece is separable from immediately adjacent chain link piece. This means that if one or more chain link pieces break during operation, one or more chain link pieces can be removed and/or replaced. In this way, using a chain for the flexible drive links 25, 35 for the linking drive system 40 increases the ease of maintenance and repair. Since at least one or more chain link pieces are separable, this means that the first and second drive shafts 23, 33 do not have to be removed during replacement of the chain.

Alternatively, as mentioned above, the flexible drive links 25, 35 are belts (not shown). In this case, the belts are a unitary loop of material. In order to replace the belt, the first and second drive shafts 23, 33 have to be removed during replacement of the belt. Optionally back up replacement belts can be initially positioned around the first and second drive shafts 23, 33 and moved into engagement with the linking drive system 40 when needed (e.g. a belt snaps during operation).

The linking drive system 40 further allows for powering and driving the first and second propulsors 26,36 if one of the prime movers 21, 31 fails. For example, if the first prime mover 21 fails, then linking drive clutch 41 is engaged allowing the rotation of the second drive shaft 33 generated by the second prime mover 31 to be transferred to the first drive shaft 23. Thus, the second prime mover 31 drives both propulsors 26, 36. Similarly, if the second prime mover 31 fails, then linking drive clutch 41 is engaged allowing the rotation of the first drive shaft 23 generated by the first prime mover 21 to be transferred to the second drive shaft 33. In some examples, the linking drive system 40 is configured to transfer 400 kW between the first and second drive shafts, 23, 33. In some examples, this is enough power to allow free sailing of the tugboat 1 without a bollard pull e.g. a towing container ship. In some examples, 300 kW-500 kW is transferred between the first and second drive shafts 23, 33. In some other examples, 100 kW-700 kW is transferred between the first and second drive shafts 23, 33. In some other examples, 100 kW-1500 kW is transferred between the first and second drive shafts 23, 33

Turning back to FIG. 3, the linking drive system 40 will be discussed in further detail. FIG. 3 shows an example wherein the at least first and second flexible drive links 25, 35 are coupled to the first and second drive shafts 23, 33 between the first and second main drive clutches 22, 32 and the first and second propulsors 26, 36. In this way, the first and second main drive clutches 22, 32 are between the first and second prime movers 21, 31 and the linking drive system 40. In some examples, the first and second main drive clutches 22, 32 can be respectively integral with the first and second propulsors 26, 36. That is, the first and second main drive clutches 22, 32 are mounted within the housing (not shown) of the first and second propulsors 26, 36 e.g. an azimuthing thruster. Alternatively, FIG. 3 schematically represents that the first and second main drive clutches 22, 32 are separate components from the first and second propulsors 26, 36.

In some types of propulsors 26, 36 hydraulic pumps (not shown) are used to control the slew of the propulsor 26, 36 and the power to drive the hydraulic pumps is taken from the first and/or the second drive shafts 23, 33 connected to the propulsor 26, 36. Therefore, if the first and second flexible drive links 25, 35 are arranged as in FIG. 3 and described above, also the hydraulic pumps will be powered all the time, even if one of the first or second prime movers 21, 31 fail.

In some examples, the flexible drive links 25, 35 are positioned between the first or second propulsors 26, 36. In this case, if the drive is transmitted between directly between the first or second propulsors 26, 36, then the hydraulic pump is positioned between the linking drive system 40 and the first and second main drive clutches 22, 32. In this less preferred example, the hydraulic drive does not receive power from the first or second drive shafts 23, 33.

Figure 5:
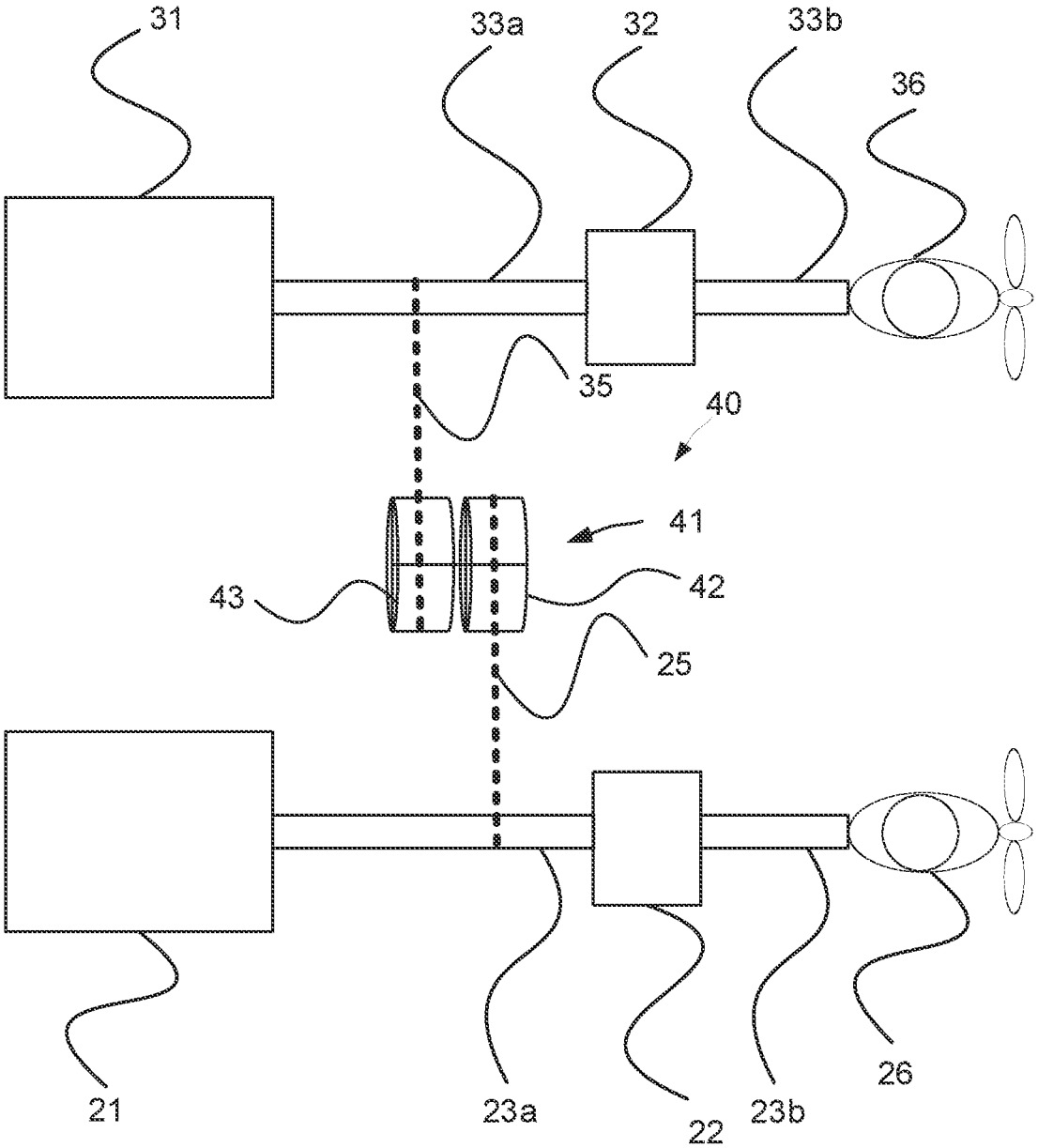
FIG. 5 shows a schematic cross-sectional top view of a tugboat having two propulsors and a linking drive system arranged between prime movers and drive clutches of the prime movers.

Another example will now be described in reference to FIG. 5. FIG. 5 shows a schematic cross-sectional top view of the tugboat 1 having the first and second propulsors 26, 36 and the first and second flexible drive links 25, 35 coupled to the first and second drive shafts 23, 33 between the first and second prime movers 21, 31 and the first and second main drive clutches 22, 32.

By having the first and second flexible drive links 25, 35 coupled in this way to the first and second drive shafts 23, 33, it is possible to use separate first and second propulsors 26, 36 and first and second main drive clutches 22, 32 compared to an integrated first and second propulsor 26, 36 and first and second main drive clutch 22, 32 arrangement (as mentioned above with respect to FIG. 3). In an example, the linking drive clutch 41 and the first and second flexible drive links 25, 35 are designed to withstand the full torque of the prime movers 21, 31. In an example, the linking drive clutch 41 and the first and second flexible drive links 25, 35 are designed to withstand the full torque of the prime movers 21, 31.

Figure 6:
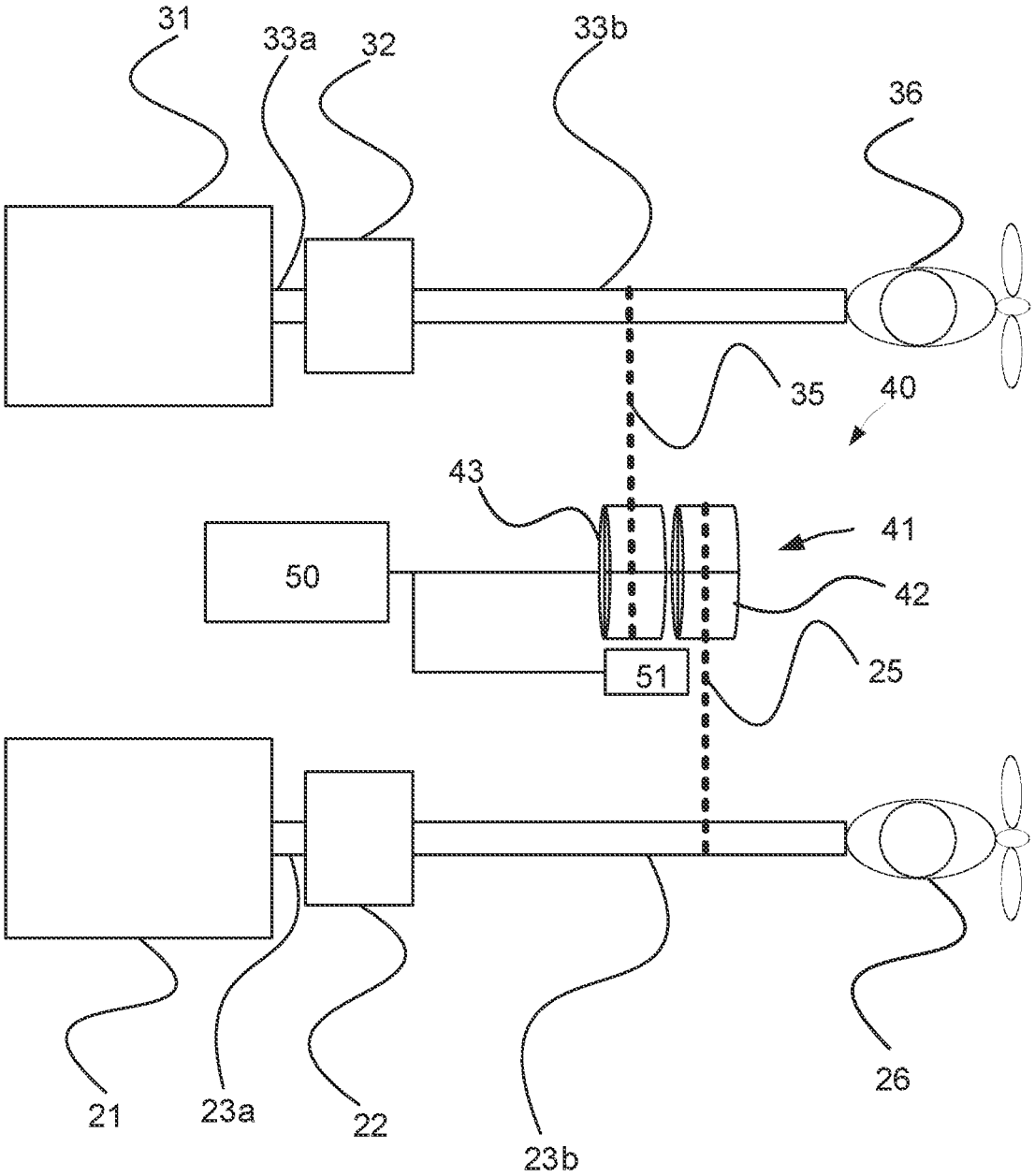
FIG. 6 shows a schematic cross-sectional top view of a tugboat having two propulsors, and a linking drive system comprising a linking drive clutch and a clutch controller.

In an example, the linking drive system 40 comprises a clutch controller 50, illustrated in FIG. 6. FIG. 6 illustrates a schematic cross-sectional top view of the tugboat 1 having the first and second propulsors, 26, 36, the linking drive system 40 comprising the linking drive clutch 41 and the clutch controller 50. The clutch controller 50 is, in an example, configured to control the engagement of the first clutch part 42 and second clutch part 43 of the linking drive clutch 41. The clutch controller 50 remotely and/or autonomously controls the linking drive clutch 41 from e.g. the wheelhouse 18 or another place on the tugboat 1.

FIG. 6 shows an example with least one rotation sensor 51. In some examples, the rotation sensor 51 determines a relative rotation between one or more parts of the first propulsion drivetrain system 20 and the second propulsion drivetrain system 30. For example, the rotation sensor 51 determines a rotation direction and/or speed of rotation of at least one of the first or second drive shafts 23, 33, the first or second flexible drive links 25, 35 or the first clutch part 42 and second clutch part 43 of the linking drive clutch 41. In some examples, the rotation sensor 51 is mounted adjacent on the first clutch part 42 and detects relative movement of the second clutch part 43 with respect to the first clutch part 42.

Figure 9A:
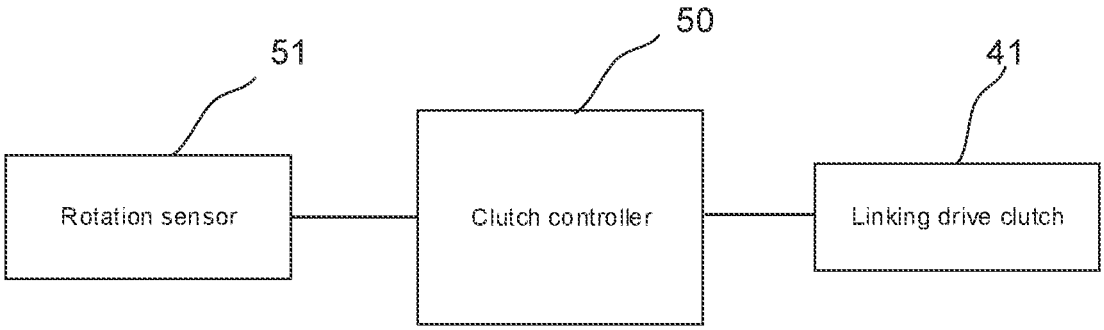
FIG. 9A shows a schematic view of a clutch controller connected to a rotation sensor and a linking drive clutch.

In FIG. 6, the rotation sensor 51 is arranged at the first and second clutch parts 42, 43. In some examples, the rotation sensor 51 is placed at the first or second drive shaft 23, 33, or at the first or second flexible drive links 25, 35. In an example, several rotation sensors 51 are used to detect the rotation of several of the first or second drive shafts 23, 33, the first or second flexible drive links 25, 35 or the first and second clutch parts 42, 43 of the linking drive clutch 41. The rotation sensor 51 can e.g. be an optical sensor, magnetic sensor, hall-effect sensor, inductive sensors, oscillatory sensor, magneto-resistive sensor or eddy current sensors. The clutch controller 50 and the rotation sensor 51 are connected to each such that a signal resulting from any detected rotation direction and/or speed of rotation from the rotation sensor 51 is sent to the clutch controller 50, illustrated in FIG. 9A. FIG. 9A shows a schematic view of the clutch controller 50 connected to the rotation sensor 51 and the linking drive clutch 41. The connection between the clutch controller 50 and the rotation sensor 51 can be e.g. wired and/or wireless.

In an example, the clutch controller 50 is configured to activate the engagement of the first and second clutch parts 42, 43 of the linking drive clutch 41. In some examples, the clutch controller 50 comprises an actuator (not shown) for moving the first clutch part 42 and second clutch part 43 between the first position in which the first clutch part 42 and second clutch part 43 are not in physical engagement and no rotation is transmitted and a second position in which the first clutch part 42 and second clutch part 43 are in physical engagement and rotation is transmitted therebetween. In some examples, the clutch controller 50 is configured to actuate the linking drive clutch 41 when a differential rotation is zero between the first clutch part 42 and second clutch part 43. In another example, the clutch controller 50 is configured to engage the first clutch part 42 and second clutch part 43 below a pre-defined threshold of speed of the differential rotation. In some examples, the threshold is below 5 revolutions per minute (rpm), 3 rpm or 1 rpm.

Figure 9B:
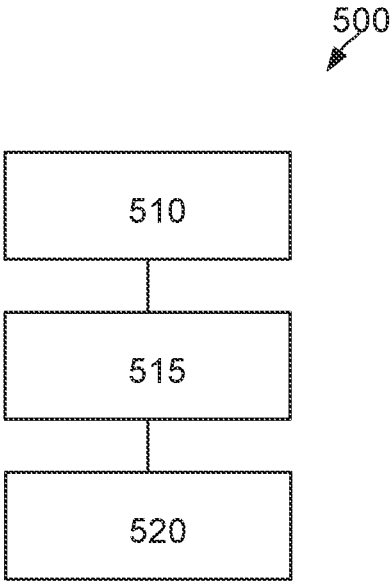
FIG. 9B shows a flowchart of a method for controlling driven and driving parts clutch by a clutch controller.

In some examples, the clutch controller 50 is configured to automatically control the linking drive clutch 41, illustrated in FIG. 9B. FIG. 9B shows a flowchart of a method 500 for controlling the linking drive clutch 41 by the clutch controller 50. In this way, the clutch controller 50 can act independently and quickly based on e.g. input from the rotation sensor 51. In some examples, the engagement between the first clutch part 42 and second clutch part 43 is actuated by the operator of the tugboat 1. However, the clutch controller 50 prevents the operator of the tugboat 1 engaging the linking drive clutch 41 when it is unsafe to do so. For example, when the first clutch part 42 and second clutch part 43 are moving relative to each other and will damage each other if the first clutch part 42 and second clutch part 43 physically engage each other.

In some examples, the clutch controller 50 is configured to actuate and selectively engage the first clutch part 42 and second clutch part 43 of the linking drive controller 41. The method 500 comprises the step of detecting a speed and/or direction of rotation 510 of least one of the first or second drive shafts 23, 33, the first or second flexible drive links 25, 35 or the first clutch part 42 and second clutch part 43 of the linking drive clutch 41. The method further comprises the step of determining 515, if the speed of rotation is below a pre-defined threshold, zero or in a same direction. Lastly, the method comprises the step of activating 520 the linking drive clutch 41 to engage the first clutch part 42 and second clutch part 43 so that rotation is transferred therebetween and between the first and second drive shafts 23, 33.

Furthermore, in some examples, the clutch controller 50 can additionally selectively engage the first clutch part 42 and second clutch part 43 of the linking drive clutch 41 based on further status information of the tugboat 1. For example, in certain pre-defined situations the clutch controller 50 receives status information of the tugboat 1 such as sudden power drop in one of the prime movers 21, 31 or faulty drive clutches 22, 32.

Illustrated in FIG. 7A is an example of the first sprocket 27 connected to the at least one flange 28 of the second part 23*b* of the first drive shaft 23. FIG. 7A illustrates that the first drive shaft 23 already comprises an existing mounting position on the first drive shaft 23 between the first and second flanges 28*a*, 28*b*. The existing open position has enough space to receive the first sprocket 27. The first sprocket 27 can be fastened via bolts 29 to the first and second flanges 28*a*, 28*b*, as illustrated in FIGS. 7A-B. Other ways of fastening the first sprocket 27 is also possible such as e.g. welding.

Illustrated in FIG. 7B is another example of the first sprocket 27 being connected to the outside surface of the first flange 28*a*. In order to connect the first sprocket 27 to the first flange 28*a* the first sprocket 27 can be in two parts, further seen in FIG. 7C. In some examples the first sprocket 27, can have a cutout that is big enough for the first sprocket 27 to be slid over the first drive shaft 23 and into place.

To protect the first and second drive chains 25, 35 they may be each enclosed in a chain box 46, illustrated in FIG. 8. FIG. 8 shows a schematic cross-sectional side view of a chain box 46 comprising the first drive chain 25 and an oiling mechanism 47.

The chain box 46 serves at least two purposes. Firstly, the chain box 46 shields the crew from the moving first and second drive chains 25, 35. Secondly, the chain box 46 protects the first and second drive chains 25, 35 from the environment. The chain box 46 may extend around the first and second drive chains 25, 35 and the first and second sprockets 27, 37 on each of the first and second drive shafts 23, 33, as illustrated in FIG. 8. The chain box 46 can also comprise a sealed bearing (not shown) for the first and second drive shafts 23, 33 to pass through.

The chain box 46 may also have an oiling mechanism 47. The oiling mechanism 47 can be an oil sump 48 or reservoir whereby the moving first or second drive chain 25, 35 dips into, illustrated in FIG. 8. This means that the moving first or second drive chain 25, 35 is constantly lubricated during operation. The oil sump 48 or reservoir can be situated in the bottom of the chain box 46. Further oiling mechanisms 47 can spray oil on to the first sprocket 27, on the first drive shaft 23, or at a first clutch sprocket 49*a* mounted on the first clutch part 42 of the linking clutch 41. FIG. 8 shows the chain box 46 for the first sprocket 27 mounted on the first drive shaft 23, the first flexible drive link 25 e.g. the first drive chain 25 and the first clutch sprocket 49*a*. An identical chain box 46 is provided for the second sprocket 37 mounted on the second drive shaft 33, the second flexible drive link 35 e.g. the second drive chain 35 and a second clutch sprocket 49*b* mounted on the second clutch part 43 of the linking clutch 41. Indeed, in some examples there are a plurality of chains used in the linking drive system 40 and each chain comprises a chain box 46. In some examples, alternatively, the spray mechanism 47 can spray oil on the first or second drive chain itself 25, 35 so that the first or second drive chain 25, 35 is constantly lubricated during operation.

The linking drive system 40 may also be a kit mountable on the existing vessel propulsion drivetrain systems 20, 30. In an example, the linking drive system 40, in the form of the kit, comprises the first sprocket 27, the second sprocket 37, the linking drive clutch 41 and the at least first and second drive chains 25, 35.

In an alternative example of a linking drive system (not shown) for linking together and driving the first and second propulsors 26, 36. A tugboat has the first and second propulsors 26, 36, and the linking drive system comprising a linking drive clutch 41 and first and second rigid drive links (not shown).

The alternative linking drive system has most of the same feature and effects as described above except that instead of the first and second flexible drive links 25, 35, any type of first and second rigid drive links can be used. So, the first and second flexible drive links 25, 35 are replaced by the first and second rigid drive links.

The placement of the first and second rigid drive links is in a same way as in FIGS. 3 and 6 of the linking drive system 40. Thus, the first and second rigid drive links are coupled on the prime mover side of hydraulic pumps for controlling slew of the first and second propulsors 26, 36. Thus, the rotation from one of the first and second drive shafts 23, 33 can be transferred to the other drive shaft 23, 33 when the clutch 41 is engaged, driving the first and second propulsors 26, 36 and the slew of the first and second propulsors 26, 36.

Figure 10:
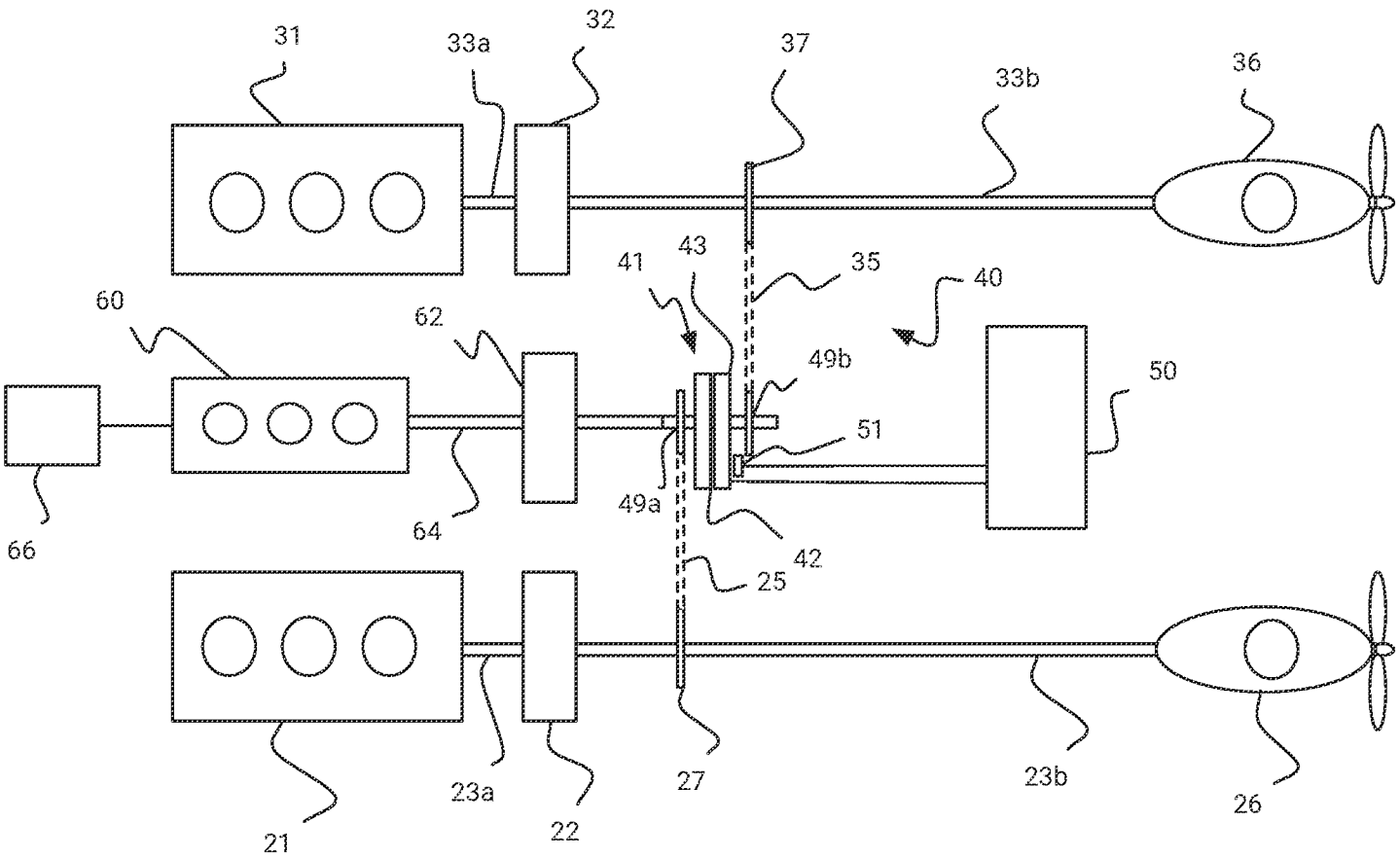
FIG. 10 shows a schematic cross-sectional top view of a tugboat having two propulsors, a linking drive system and a fire fighting engine.

Another example will be discussed in reference to FIG. 10. FIG. 10 shows a schematic cross-sectional top view of a tugboat 1 having two propulsors 26, 36 and a linking drive system 40. The example shown in FIG. 10 is the same as the examples shown in reference to the previous examples discussed in reference to FIGS. 1 to 9A, 9B. However, the tugboat 1 as shown in FIG. 10 optionally comprises a firefighting engine 60. The firefighting engine 60 can selectively be coupled to the linking drive system 40 which will be discussed hereinafter.

The firefighting engine 60 is arranged to drive a firefighting system 66. The firefighting (FIFI) system 66 comprises at least one pump (not shown) for pumping water out of a nozzle (not shown). The firefighting engine 60 is coupled to the linking drive system 40 via firefighting engine drive shaft 64 and firefighting clutch 62.

In this way, the firefighting engine 60 can be used to divert drive to either propulsor 36, 26. For example, this may be required if both the first and second prime movers 21, 31 are not operational.

The firefighting clutch 62 selectively engages the firefighting engine 60 to the linking drive system 40. In normal operation, the firefighting engine 60 is isolated the from the linking drive system 40 and the firefighting clutch 62 is disengaged. In normal operation, the linking drive clutch 41 is also disengaged and the first propulsion drivetrain system 20 and the second propulsion drivetrain system 30 not linked.

Alternatively, if the firefighting clutch 62 is disengaged, and one of the first or second prime movers 21, 31 is not operational, the other prime mover 21, 31 can provide drive to both the first and the second propulsors 26, 36 similar to the previous examples discussed in reference to FIGS. 1 to 9A, 9B.

The clutch controller 50 can be of a pure software character and include programming instructions described herein for detection of input conditions and control of output conditions, illustrated in FIG. 9A and discussed above. The programming instructions can be stored in a memory of the clutch controller 50, not shown. In some examples, the programming instructions correspond to the processes and functions described herein. The clutch controller 50 can be executed by a hardware processor. The programming instructions can be implemented in C, C++, JAVA, or any other suitable programming languages. In some examples, some or all of the portions of the clutch controller 50 can be implemented in application specific circuitry such as ASICs and FPGAs.

In other examples, two or more of the above described examples may be combined. In other examples, features of one example may be combined with features of one or more other examples. Embodiments of the present invention have been discussed with particular reference to the examples illustrated. However, it will be appreciated that variations and modifications may be made to the examples described within the scope of the invention.

What is claimed is:

1. A linking drive system for coupling together a first drivetrain and a second drivetrain of a vessel, the linking drive system comprising:

the first drivetrain connecting a first prime mover and a first propulsor, the first drivetrain comprising a first drive shaft;

the second drivetrain connecting a second prime mover and a second propulsor, the second drivetrain comprising a second drive shaft;

a linking drive clutch, the linking drive clutch comprising at least a first clutch part and a second clutch part which are engageable with each other and can transmit rotation therebetween;

at least one flexible drive link separate from the first and second drivetrains, the at least one flexible drive link coupled between the linking drive clutch and the first and/or second drive trains, wherein the at least one flexible drive link is coupled between the linking drive clutch and the first and/or second drive shafts;

wherein the linking drive clutch is engageable to allow rotation of one of the first and second drive shafts, generated by a respective one of the first and second prime movers, to be transferred to the other of the first and second drive shafts, and wherein the at least one flexible drive link comprises:

at least a first flexible drive link, the first flexible drive link being coupled between the first drive shaft and the first clutch part of the linking drive clutch; and at least a second flexible drive link coupled between the second drive shaft and the second clutch part of the linking drive clutch.

2. A linking drive system according to claim 1, wherein the linking drive system comprises a chain drive or a belt drive.

3. A linking drive system according to claim 1, wherein the at least first and second flexible drive links are coupled to the first and second drive shafts on a prime mover side of a main drive clutch.

4. A linking drive system according to claim 1, wherein the at least first and second flexible drive links are coupled to the first and second drive shafts on a propeller side of a main drive clutch.

5. A linking drive system according to claim 4, wherein the at least first and second flexible drive links are coupled to the first and second drive shafts on a linking drive clutch side of a hydraulic pump of the propulsor such that the hydraulic pump can operate a slew of the propulsor when the linking drive clutch is engaged.

6. A linking drive system according to claim 1, further comprising a linking drive clutch controller configured to control the engagement of the first clutch part and the second clutch part.

7. A linking drive system according to claim 6, further comprising a sensor for detecting a rotation of at least one of the first and second drive shafts, the first and second flexible drive links or the first clutch part and the second clutch part.

8. A linking drive system according to claim 7, wherein the linking drive clutch controller is configured to activate the engagement of the first clutch part and the second clutch part when there is no relative rotation, or below a predefined threshold rotation.

9. A linking drive system according to claim 1, wherein the linking drive clutch is an electromagnetic clutch.

10. A linking drive system according to claim 1, wherein the linking drive system is a chain drive system and the chain drive system comprises at least a first sprocket and a second sprocket, wherein the first sprocket is coupled to the first drive shaft and the second sprocket is coupled to the second drive shaft, and the at least first and the at least second flexible drive links are chains.

11. A linking drive system according to claim 10, wherein the chains are each enclosed in a chain box.

12. A linking drive system according to claim 11, wherein the chain box comprises a reservoir or a spraying device for lubricating the chains.

13. A linking drive system according to claim 10, further comprising at least one diverter sprocket, the diverter sprocket is arranged such that the direction of at least a portion of the chain drive system is diverted.

14. A vessel comprising a drive system for coupling together a first drivetrain and a second drivetrain of the vessel, the drive system comprising:

the first drivetrain connecting a first prime mover and a first propulsor, the first drivetrain comprising a first drive shaft;

the second drivetrain connecting a second prime mover and a second propulsor, the second drivetrain comprising a second drive shaft;

a linking drive clutch, the linking drive clutch comprising at least a first clutch part and a second clutch part which are engageable with each other and can transmit rotation therebetween;

at least one flexible drive link separate from the first and second drivetrains, the at least one flexible drive link coupled between the linking drive clutch and the first and/or second drive trains, wherein the at least one flexible drive link is coupled between the linking drive clutch and the first and/or second drive shafts;

wherein the linking drive clutch is engageable to allow rotation of one of the first and second drive shafts, generated by a respective one of the first and second prime movers, to be transferred to the other of the first and second drive shafts, and wherein the at least one flexible drive link comprises:

at least a first flexible drive link, the first flexible drive link being coupled between the first drive shaft and the first clutch part of the linking drive clutch; and at least a second flexible drive link coupled between the second drive shaft and the second clutch part of the linking drive clutch.

15. A vessel according to claim 14 wherein the vessel is a tugboat.

16. A linking drive kit mountable on a vessel drive system for coupling together a first drivetrain and a second drivetrain of a vessel, the linking drive kit comprising:

a linking drive clutch, the linking drive clutch comprises at least a first clutch part and a second clutch part which are engageable with each other and can transmit rotation therebetween;

at least a first chain separate from the first and second drivetrains, the first chain coupled between the first drive train and the first clutch, wherein the first chain is coupled between a first drive shaft of the first drivetrain and the first clutch part of the linking drive clutch, the first drivetrain connecting a first prime mover and a first propulsor; and at least a second chain separate from the first and second drivetrains, the second chain coupled between the second drivetrain and the second clutch part, wherein the second chain is coupled between a second drive shaft of the second drivetrain and the second clutch part of the linking drive clutch, the second drivetrain connecting a second prime mover and a second propulsor;

wherein the linking drive clutch is engageable to allow the rotation of one of the first and second drive shafts, generated by a respective one of the first and second prime movers, to be transferred to the other of the first and second drive shafts.

* * * * *